US011521547B2

(12) United States Patent
Nishiyama

(10) Patent No.: US 11,521,547 B2
(45) Date of Patent: Dec. 6, 2022

(54) DISPLAY DEVICE

(71) Applicant: SHARP KABUSHIKI KAISHA, Sakai (JP)

(72) Inventor: Takayuki Nishiyama, Sakai (JP)

(73) Assignee: SHARP KABUSHIKI KAISHA, Osaka (JP)

( * ) Notice: Subject to any disclaimer, the term of this patent is extended or adjusted under 35 U.S.C. 154(b) by 0 days.

(21) Appl. No.: 16/982,528

(22) PCT Filed: Mar. 27, 2018

(86) PCT No.: PCT/JP2018/012572
§ 371 (c)(1),
(2) Date: Sep. 18, 2020

(87) PCT Pub. No.: WO2019/186723
PCT Pub. Date: Oct. 3, 2019

(65) Prior Publication Data

US 2021/0027709 A1 Jan. 28, 2021

(51) Int. Cl.

| | |
|---|---|
| ***G09G 3/3233*** | (2016.01) |
| ***G09G 3/3266*** | (2016.01) |
| ***G09G 3/3291*** | (2016.01) |

(52) U.S. Cl.
CPC ..... *G09G 3/3233* (2013.01); *G09G 3/3266* (2013.01); *G09G 3/3291* (2013.01)

(58) Field of Classification Search
CPC ... G09G 3/3233; G09G 3/3266; G09G 3/3291
See application file for complete search history.

(56) References Cited

U.S. PATENT DOCUMENTS

| | | | |
|---|---|---|---|
| 2012/0327058 | A1 | 12/2012 | Minami et al. |
| 2014/0239846 | A1 | 8/2014 | Shoji et al. |

FOREIGN PATENT DOCUMENTS

| | | | |
|---|---|---|---|
| JP | 2012242772 | A | * 12/2012 |
| JP | 2013-003568 | A | 1/2013 |
| JP | 2014-044316 | A | 3/2014 |
| JP | 2014-164081 | A | 9/2014 |

* cited by examiner

*Primary Examiner* — Stacy Khoo
(74) *Attorney, Agent, or Firm* — ScienBiziP, P.C.

(57) ABSTRACT

A display device includes a display element emitting a light by a current flowing, a drive transistor controlling the current flowing through the display element, and a diode connection transistor connected to a source side of the drive transistor, and a constant potential is input to a back gate of the drive transistor.

4 Claims, 13 Drawing Sheets

DISPLAY DEVICE

TECHNICAL FIELD

The disclosure relates to a display device, particularly to an active matrix display device.

BACKGROUND ART

Well known electro-optical elements constituting pixels arranged in a matrix include a current-driven organic EL element. In recent years, display devices including organic Electro Luminescence (EL) in pixels, that can enlarge and thin a display incorporating a display device, and attracts attention for vividness of a displayed image, have been actively developed.

In particular, an active matrix display device is often provided in which current-driven electro-optical elements and switch elements such a Thin Film Transistor (TFT) that individually controls the current-driven electro-optical element are provided to respective pixels, and each electro-optical element is controlled for each pixel. This is because, by using an active matrix display device, higher-resolution image display can be performed than that of a passive display device.

Here, the active matrix display device is provided with a connection line formed along a horizontal direction for each row, and a data line and a power supply line formed along a vertical direction for each column. Each pixel includes an electro-optical element, a connection transistor, a drive transistor, and a capacitance. The connection transistor can be turned on by applying a voltage to the connection line, and data can be written by charging a data voltage (data signal) on the data line to the capacitance. Then, the drive transistor can be turned on by the data voltage charged to the capacitance to flow a current from the power supply line through the electro-optical element, and thereby, the pixels are caused to emit light.

Accordingly, in the active matrix organic EL display device using the organic EL elements, the current value flowing through the organic EL element of each pixel is controlled by the voltage applied to the drive transistor to emit light at a desired luminance, realizing a gray scale expression of each pixel. Furthermore, in a case that the organic EL display device is displayed at low luminance, the current flowing through each organic EL element needs to be reduced, so a subthreshold region in which a gate-source voltage of the drive transistor is equal to or less than a threshold value has been used.

CITATION LIST

Patent Literature

PTL 1: JP 2014-44316 A

SUMMARY

Technical Problem

However, subthreshold characteristics of the drive transistor are regions where a current value changes abruptly with changes in a gate voltage, and a gate voltage difference to express a difference of one gray scale may be smaller than an incremental value of the data driver supplying the data voltage, and thus, it has been difficult to achieve a good gray scale expression. In addition, there has been a problem in that the gray scale expression for each pixel is affected by the characteristic variation of the drive transistor, and gray scale unevenness is generated.

Therefore, an object of the disclosure is to provide a display device capable of reducing the effect of characteristic variation of a drive transistor and achieving a favorable gray scale expression even at a low luminance.

Solution to Problem

A display device according to the disclosure includes a display element emitting a light by a current flowing, a drive transistor controlling a current flowing through the display element, and a diode connection transistor connected to a source side of the drive transistor, wherein a constant potential is input to a back gate of the drive transistor.

In such a display device, a relationship between a gate voltage and a current value in the subthreshold characteristics of the drive transistor is adjusted by the constant potential input to the back gate of the drive transistor, so that an effect of characteristic variation of the drive transistor can be reduced and a favorable gray scale expression can be achieved even at a low luminance.

In addition, in an aspect of the disclosure, the constant potential is constant for a period while the drive transistor is in an on operation.

In an aspect of the disclosure, a ground wiring line is electrically connected to the back gate.

In an aspect of the disclosure, one side of a capacitance is connected to the back gate, and the other side of the capacitance is connected to a ground potential.

In an aspect of the disclosure, a low level or high level power source wiring line is electrically connected to the back gate.

In an aspect of the disclosure, an initialization wiring line is electrically connected to the back gate.

In an aspect of the disclosure, the diode connection transistor is provided between a high level power source wiring line and the drive transistor.

In an aspect of the disclosure, the display device further includes a first transistor including a drain connected to a high level power source wiring line and a gate connected to a light emission control line, a second transistor including a source connected to an anode of the display element and a gate connected to a light emission control line, a reset transistor including a drain connected to an initialization line and a gate connected to a first scanning line, a switching transistor including a source connected to a data line and a gate connected to a second scanning line, a third transistor including a source connected to a source of the first transistor and a gate connected to the second scanning line, and a second capacitance, wherein the drive transistor and the diode connection transistor are connected between the source of the first transistor and a drain of the second transistor, a gate of the drive transistor, a drain of the third transistor, a source of the reset transistor, and one side of the second capacitance are connected to a first node, and a source of the diode connection transistor, the drain of the second transistor, the other side of the second capacitance, a drain of the switching transistor, and the back gate are connected to a second node.

In an aspect of the disclosure, when a back gate side capacitance of the drive transistor is $C_{BGI}$, a drive gate side capacitance is $C_{GI}$, and a capacitance ratio $k=C_{BGI}/C_{GI}$, a subthreshold coefficient S obtained by combining the drive transistor and the diode connection transistor is expressed by a linear function of k.

In an aspect of the disclosure, when a subthreshold coefficient of only the drive transistor or the diode connection transistor is $S_0$, the subthreshold coefficient S obtained by combining the drive transistor and the diode connection transistor is defined by $S=(2+k)S_0$.

Advantageous Effects of Disclosure

According to the disclosure, it is possible to provide a display device capable of reducing the effect of characteristic variation of a drive transistor and achieving a favorable gray scale expression even at a low luminance.

DESCRIPTION OF EMBODIMENTS

First Embodiment

Figure 1:
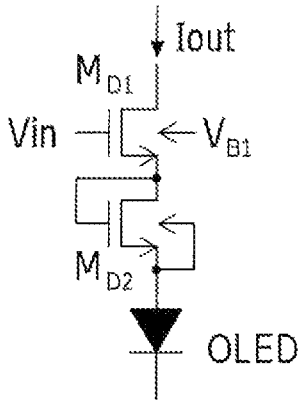
FIG. 1 is a circuit diagram illustrating one pixel of an organic EL display device according to a first embodiment.

Hereinafter, an embodiment according to the disclosure will be described with reference to the drawings. Note that in the present specification and the drawings, constituent elements having substantially the same functions are designated by the same reference signs, and duplicated descriptions of such configurations are omitted. FIG. 1 is a circuit diagram illustrating one pixel of an organic EL display device according to the present embodiment. As illustrated in FIG. 1, the organic EL display device includes a drive transistor $M_{D1}$, a diode connection transistor $M_{D2}$, and an organic EL element OLED.

The drive transistor $M_{D1}$ is a transistor that controls a current value flowing when a voltage is applied to a gate, and can include, for example, a metal-oxide-semiconductor field-effect transistor (MOSFET) or the like. The drive transistor $M_{D1}$ has a source connected to the diode connection transistor $M_{D2}$, a drain connected to a current source, and a back gate to which a constant potential $V_{B1}$ is input, where a data voltage $V_{in}$ is applied to the gate to cause a current $I_{out}$ to flow. Here, the constant potential $V_{B1}$ indicates that the drive transistor $M_{D1}$ is substantially constant for a period of an on operation, that is, at least for a light emission period, and need not be substantially constant over the entire operation period of the organic EL display device. In addition, "substantially constant" means that the voltage is not intentionally changed, and includes a case that a predetermined voltage is continuously applied from outside or a case that the voltage applied from outside is held. Although FIG. 1 illustrates a drive transistor $M_{D1}$ with n-type channel, it may be with p-type channel.

Here, the back gate of a transistor such as the drive transistor $M_{D1}$ and the diode connection transistor $M_{D2}$ refers to a gate electrode formed on the opposite side of a gate electrode that inputs the data voltage. For example, in the case of a structure in which the gate electrode is formed over and under a semiconductor layer via a gate insulating film, when the data voltage is input to a top gate electrode, a bottom gate electrode serves as a back gate, and when the data voltage is input to the bottom gate electrode, the top gate electrode serves as a back gate.

The diode connection transistor $M_{D2}$ is a transistor connected in series to the source of the drive transistor $M_{D1}$, and may be a MOSFET similar to the drive transistor $M_{D1}$, for example. The diode connection transistor $M_{D2}$ has a drain connected to the source of the drive transistor $M_{D1}$, and a source connected to the organic EL element OLED. The gate and drain of the diode connection transistor $M_{D2}$, which are short-circuited, are configured to be commonly known as a diode connection for a transistor.

A back gate and source of the diode connection transistor $M_{D2}$ are short-circuited. The back gate and source of the diode connection transistor $M_{D2}$ may not be short-circuited, but short-circuiting can prevent the electric field from wrapping and improve the saturation of the MOSFET.

The organic EL element OLED is an electro-optical element that emits light by the current flowing, and is an element constituting one pixel of the organic EL display device. The organic EL element OLED has an anode connected to the source of the diode connection transistor $M_{D2}$. Here, only one of RGB colors constituting one pixel of the organic EL display device is exemplified.

In the organic EL display device of the present embodiment illustrated in FIG. 1, a relationship between the gate voltage and the current value in the subthreshold characteristics of the drive transistor $M_{D1}$ is adjusted by the constant potential $V_{B1}$ input to the back gate of the drive transistor $M_{D1}$ so that a change in the current value due to a change in the gate voltage is gradual. Accordingly, a subthreshold region of the drive transistor $M_{D1}$ is widened, and a difference between the data voltages $V_{in}$ required to change the current $I_{out}$ by one gray scale is increased, and gray scale control can be performed favorably within a control range of the voltage value output from the data driver. This can reduce the effect of characteristic variation of a drive transistor and achieve a favorable gray scale expression even at a low luminance.

Figure 2:
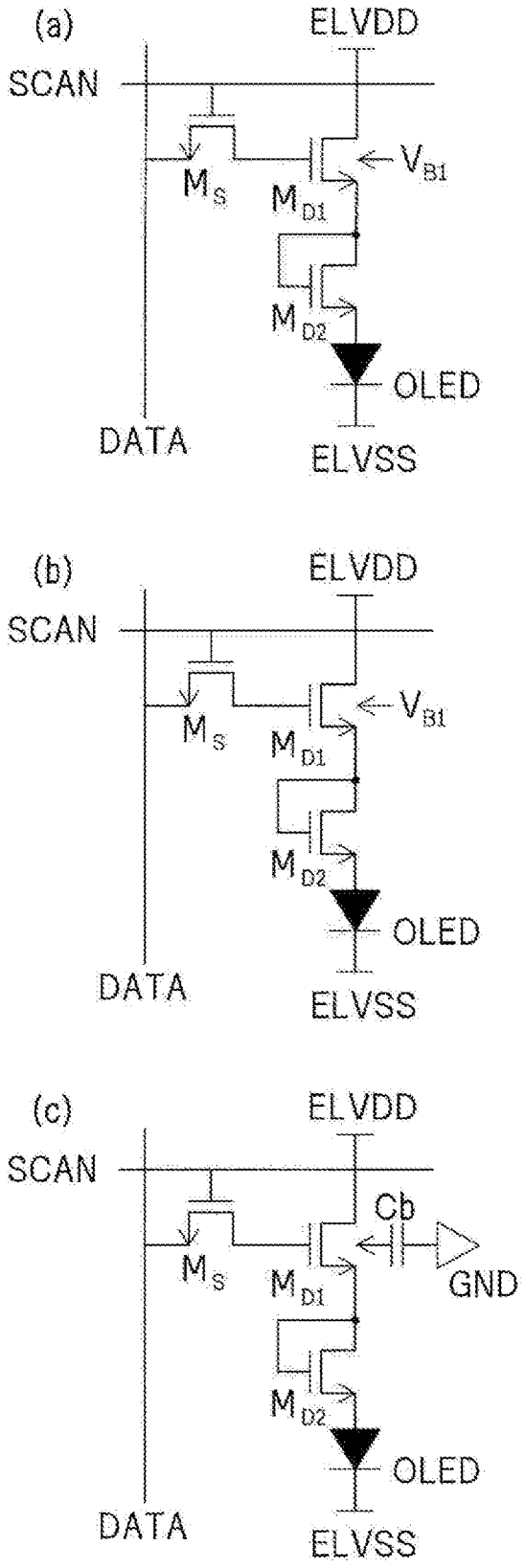
FIG. 2 is a circuit diagram illustrating organic EL display devices according to Modification Examples 1 to 3 of the first embodiment, where FIG. 2(*a*) illustrates Modification Example 1, FIG. 2(*b*) illustrates Modification Example 2, and FIG. 2(*c*) illustrates Modification Example 3.

Next, Modification Examples of the first embodiment will be described with reference to FIG. 2 to FIG. 6. FIG. 2 is a circuit diagram illustrating organic EL display devices according to Modification Examples 1 to 3 of the first embodiment, where FIG. 2(*a*) illustrates Modification Example 1, FIG. 2(*b*) illustrates Modification Example 2, and FIG. 2(*c*) illustrates Modification Example 3.

FIG. 2(*a*) is a circuit diagram illustrating Modification Example 1 of the first embodiment. As illustrated in FIG. 2(*a*), the organic EL display device of the present modification example includes a drive transistor $M_{D1}$, a diode connection transistor $M_{D2}$, an organic EL element OLED, a switching transistor $M_S$, a data line DATA, a scanning line SCAN, a high level power source line ELVDD, and a low level power source line ELVSS. The present modification example differs from the first embodiment illustrated in FIG. 1 in that a back gate and source of the diode connection transistor $M_{D2}$ are not short-circuited.

The drive transistor $M_{D1}$ has the source connected to the diode connection transistor $M_{D2}$, a drain connected to the high level power source line ELVDD, and a gate connected to a drain of the switching transistor $M_S$. A constant potential $V_{B1}$ is input to the back gate. The constant potential $V_{B1}$ input to the back gate may be provided by being supplied with a constant voltage from an external circuit, and, for example, when configured to be supplied with a ground potential, it is not necessary to add special circuits for realizing a constant power supply, and thus, the number of components can be preferably reduced.

The diode connection transistor $M_{D2}$ has a drain connected to the source of the drive transistor $M_{D1}$, the source connected to the organic EL element OLED, and a gate and the drain short-circuited. The organic EL element OLED has an anode connected to the source of the diode connection transistor $M_{D2}$ and a cathode connected to the low level power source line ELVSS. The switching transistor $M_S$ has a drain connected to the gate of the drive transistor $M_{D1}$, a source connected to the data line DATA, and a gate connected to the scanning line SCAN.

When an on signal is applied to the scanning line SCAN, the switching transistor $M_S$ turns on, and a data voltage supplied to the data line DATA is applied to the gate of the drive transistor $M_{D1}$. This turns on the drive transistor $M_{D1}$ to flow a current between the high level power source line ELVDD and the low level power source line ELVSS, and the organic EL element OLED emits light at a luminance corresponding to a current value. The current value flowing at this time corresponds to a voltage $V_{in}$ supplied from the data driver to the data line DATA.

In the present modification example also, a relationship between the gate voltage and the current value in the subthreshold characteristics of the drive transistor $M_{D1}$ is adjusted by the constant potential $V_{B1}$ input to the back gate of the drive transistor $M_{D1}$ so that the change in the current value due to the change in the gate voltage is gradual. This can reduce the effect of characteristic variation of a drive transistor and achieve a favorable gray scale expression even at a low luminance.

FIG. 2(*b*) is a circuit diagram illustrating Modification Example 2 of the first embodiment. The present modification example differs from Modification Example 1 in that the back gate of the drive transistor $M_{D1}$ is not connected to any signal line, and the constant potential $V_{B1}$ is floating.

FIG. 2(*c*) is a circuit diagram illustrating Modification Example 3 of the first embodiment. The present modification example differs from Modification Example 1 in that a capacitance $C_b$ is connected to the back gate of the drive transistor $M_{D1}$. As illustrated in FIG. 2(*c*), the capacitances $C_b$ has one side connected to the back gate and the other side connected to a ground potential GND. In the present modification example, by connecting the capacitance $C_b$ to the back gate, following the source due to a parasitic capacitance can be reduced.

Figure 3:
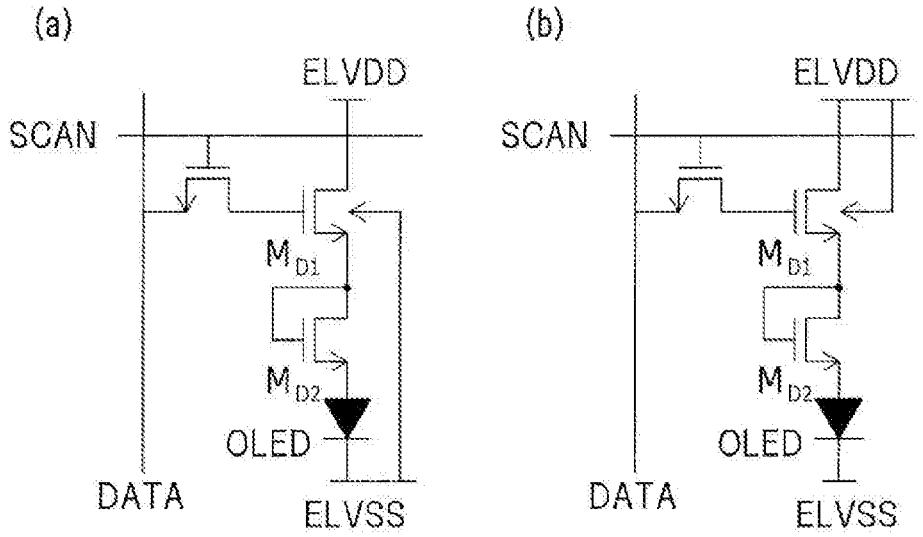
FIG. 3 is a circuit diagram illustrating organic EL display devices according to Modification Examples 4 and 5 of the first embodiment, where FIG. 3(*a*) illustrates Modification Example 4 and FIG. 3(*b*) illustrates Modification Example 5.

FIG. 3 is a circuit diagram illustrating organic EL display devices according to Modification Examples 4 and 5 of the first embodiment, where FIG. 3(*a*) illustrates Modification Example 4 and FIG. 3(*b*) illustrates Modification Example 5.

FIG. 3(*a*) is a circuit diagram illustrating Modification Example 4 of the first embodiment. The present modification example differs from Modification Example 1 in that the back gate of the drive transistor $M_{D1}$ is connected to the low level power source line ELVSS. In the present Modification Example, the constant potential $V_{B1}$ input to the back gate is the potential supplied to the low level power source line ELVSS. This can realize wiring line in the pixel without adding a special circuit for inputting the constant potential $V_{B1}$ to the back gate of the drive transistor $M_{D1}$, and thus, the number of components can be preferably reduced.

FIG. 3(*b*) is a circuit diagram illustrating Modification Example 5 of the first embodiment. The present modification example differs from Modification Example 1 in that the back gate of the drive transistor $M_{D1}$ is connected to the high level power source line ELVDD. In the present Modification Example, the constant potential $V_{B1}$ input to the back gate is the potential supplied to the high level power source line ELVDD. This can realize wiring line in the pixel without adding a special circuit for inputting the constant potential $V_{B1}$ to the back gate of the drive transistor $M_{D1}$, and thus, the number of components can be preferably reduced.

Figure 4:
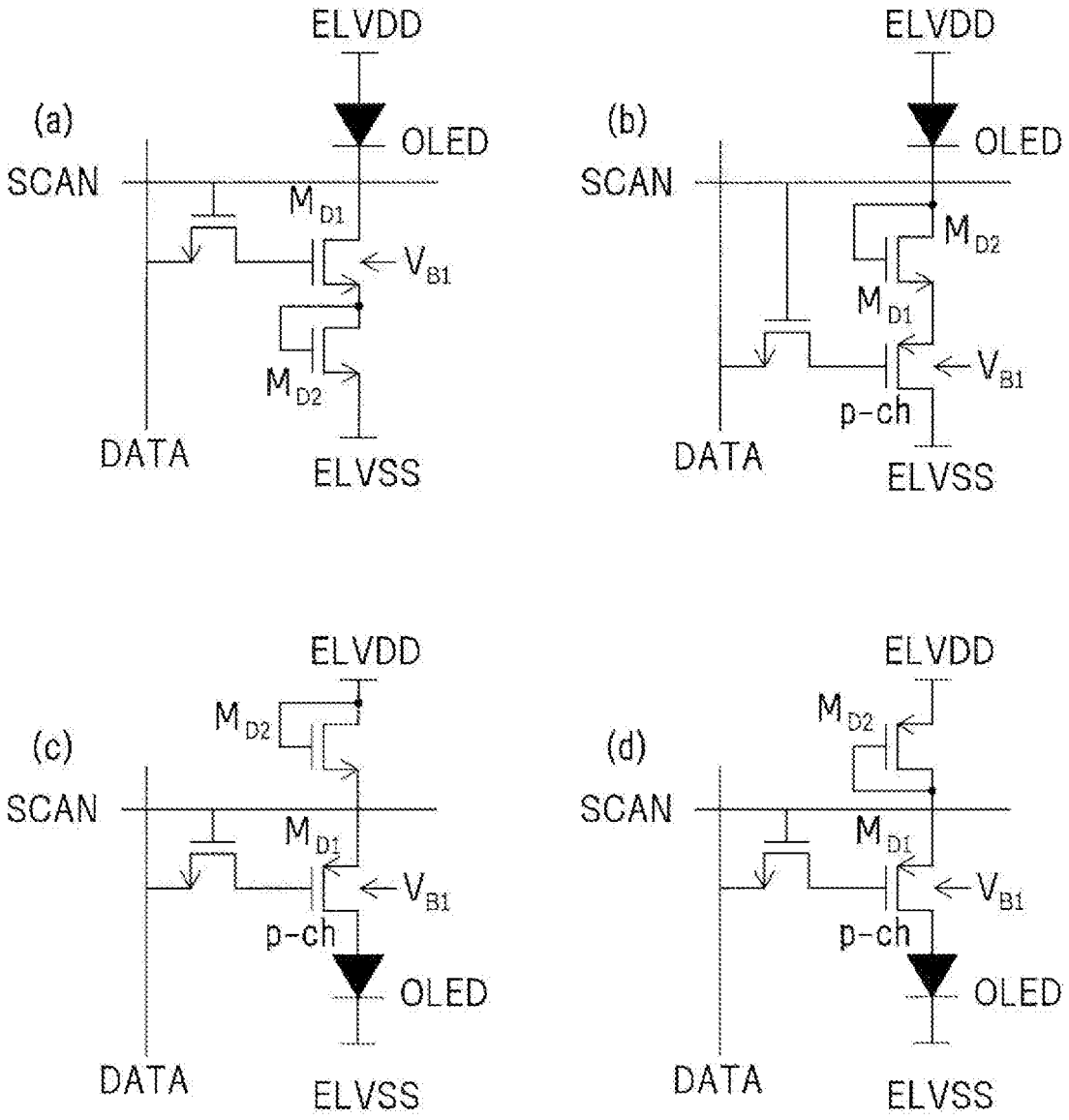
FIG. 4 is a circuit diagram illustrating organic EL display devices according to Modification Examples 6 to 9 of the first embodiment, where FIG. 4(*a*) illustrates Modification Example 6, FIG. 4(*b*) illustrates Modification Example 7, FIG. 4(*c*) illustrates Modification Example 8, and FIG. 4(*d*) illustrates Modification Example 9.

FIG. 4 is a circuit diagram illustrating organic EL display devices according to Modification Examples 6 to 9 of the first embodiment, where FIG. 4(*a*) illustrates Modification Example 6, FIG. 4(*b*) illustrates Modification Example 7, FIG. 4(*c*) illustrates Modification Example 8, and FIG. 4(*d*) illustrates Modification Example 9.

FIG. 4(*a*) is a circuit diagram illustrating Modification Example 6 of the first embodiment. The present modification example differs from Modification Example 1 in that the organic EL element OLED is provided between the drive transistor $M_{D1}$ and the high level power source line ELVDD. As illustrated in FIG. 4(*a*), the organic EL element OLED has an anode connected to the high level power source line ELVDD and a cathode connected to the drain of the drive transistor $M_{D1}$. The diode connection transistor $M_{D2}$ has a source connected to the low level power source line ELVSS.

The present modification example can also obtain similar advantageous effects to those of the first embodiment.

FIG. 4(*b*) is a circuit diagram illustrating Modification Example 7 of the first embodiment. The present modification example differs from Modification Example 6 in that the drive transistor $M_{D1}$ with a p-type channel is used and the diode connection transistor $M_{D2}$ is provided between the drive transistor $M_{D1}$ and the organic EL element OLED. As illustrated in FIG. 4(*b*), the drive transistor $M_{D1}$ has a source connected to the source of the diode connection transistor $M_{D2}$ and a drain connected to the low level power source line ELVSS. The diode connection transistor $M_{D2}$ has a drain connected to a cathode of the organic EL element OLED. As in the present modification example, even if the drive transistor $M_{D1}$ with a p-type channel is used, advantageous effects similar to those of the first embodiment can be obtained.

FIG. 4(*c*) is a circuit diagram illustrating Modification Example 8 of the first embodiment. The present modification example differs from Modification Example 7 in that the organic EL element OLED is provided between the drive transistor $M_{D1}$ and the low level power source line ELVSS. As illustrated in FIG. 4(*c*), the drive transistor $M_{D1}$ has a source connected to a source of the diode connection transistor $M_{D2}$ and a drain connected to an anode of the organic EL element OLED. The drain of the diode connection transistor $M_{D2}$ has a drain connected to the high level power source line ELVDD. The organic EL element OLED has a cathode connected to the low level power source line ELVSS. The present modification example can also obtain similar advantageous effects to those of the first embodiment.

FIG. 4(*d*) is a circuit diagram illustrating Modification Example 9 of the first embodiment. The present modification example differs from Modification Example 8 in that the diode connection transistor $M_{D2}$ with a p-type channel is used. As illustrated in FIG. 4(*d*), the diode connection transistor $M_{D2}$ has a source connected to the high level power source line EVLDD and a drain connected to a source of the drive transistor $M_{D1}$. As in the present modification example, even if the diode connection transistor $M_{D2}$ with a p-type channel is used, advantageous effects similar to those of the first embodiment can be obtained.

Figure 5:
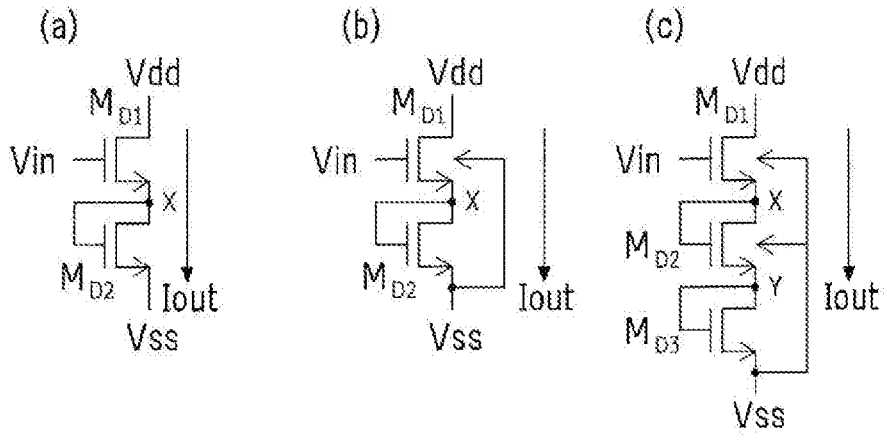
FIG. 5 is a circuit diagram illustrating organic EL display devices according to Comparative Example 1 and Modification Examples 10 and 11 of the first embodiment, where FIG. 5(*a*) illustrates Comparative Example 1, FIG. 5(*b*) illustrates Modification Example 10, and FIG. 5(*c*) illustrates Modification Example 11.

FIG. 5 is a circuit diagram illustrating organic EL display devices according to Comparative Example 1 and Modification Examples 10 and 11 of the first embodiment, where FIG. 5(*a*) illustrates Comparative Example 1, FIG. 5(*b*) illustrates Modification Example 10, and FIG. 5(*c*) illustrates Modification Example 11. In the figures, a high level side voltage is denoted by VDD, a low level side voltage is denoted by VSS, and the organic EL element is omitted from the figures.

Here, assume that in a single transistor, a gate-source voltage is Vgs, a threshold voltage is Vth, a back gate-source voltage is Vbs, a current value is Iout, a back gate side capacitance of the transistor is $C_{BGI}$, a drive gate side capacitance is $C_{GI}$, a capacitance ratio $k=C_{BGI}/C_{GI}$, and a subthreshold coefficient is $S_0$, to give modeling as the following mathematical formula.

$$I\text{out}=\beta \exp(\gamma(Vgs-Vth+kVbs)) \quad \text{(Equation 1)}$$

$$S_0=\partial Vgs/\partial \log_{10} I\text{out}=1/\gamma\cdot\log_e 10 \quad \text{[Equation 2]}$$

FIG. 5(*a*) is a circuit diagram illustrating Comparative Example 1. The present comparative example differs from Modification Example 1 in that the constant potential $V_{B1}$ is not input to the back gate of the drive transistor $M_{D1}$. If the drive transistor $M_{D1}$ and the diode connection transistor $M_{D2}$ are formed with the same configuration in the pixel using the same process, transistor characteristics of both are sufficiently approximated to such an extent that they are considered to be the same, and β, γ, and Vth are equal to each other.

In FIG. 5(*a*), when a potential of a connection point x of the drive transistor $M_{D1}$ and the diode connection transistor $M_{D2}$ is Vx, the following mathematical formulas hold:

$$I\text{out}\propto\beta \exp \gamma(V\text{in}-Vx-Vth))=\beta \exp(\gamma(Vx-VSS-Vth)) \quad \text{(Equation 3)}$$

$$Vx=(V\text{in}+VSS)/2. \quad \text{(Equation 4)}$$

Substitute Equation 4 into Equation 3, the following mathematical formula is obtained:

$$I\text{out}\propto\beta \exp(\gamma(V\text{in}-VSS-2Vth)/2) \quad \text{(Expression 5)}$$

The subthreshold coefficient S obtained by combining the drive transistor $M_{D1}$ and the diode connection transistor $M_{D2}$ is as below:

$$S=2S_0 \quad \text{(Equation 6)}$$

FIG. 5(*b*) is a circuit diagram illustrating Modification Example 10 of the first embodiment. The present modification example differs from Comparative Example 1 in that a low level side voltage VSS of the diode connection transistor $M_{D2}$ is input to the back gate of the drive transistor $M_{D1}$. In the present modification example, $V_{B1}$=VSS holds for the constant potential $V_{B1}$ input to the back gate of the drive transistor $M_{D1}$. Using the above-described modeling and calculation, the subthreshold coefficient S obtained by combining the drive transistor $M_{D1}$ and diode connection transistor $M_{D2}$ according to the present modification example is as below:

$$S=(2+k)S_0 \quad \text{(Equation 7)}$$

Accordingly, it can be found that the subthreshold coefficient S can be expressed by a linear function of k by inputting the low level side voltage VSS into the back gate of the drive transistor $M_{D1}$, and that the subthreshold coefficient S is increased by $kS_0$ more than in Comparative Example 1.

This adjusts the relationship between the gate voltage and the current value in the subthreshold characteristics of the drive transistor $M_{D1}$ so that the change in the current value due to the change in the gate voltage is gradual. Accordingly, a subthreshold region of the drive transistor $M_{D1}$ is widened, and a difference between the data voltages $V_{in}$ required to change the current $I_{out}$ by one gray scale is increased, and gray scale control can be performed favorably within a control range of the voltage value output from the data driver. This can reduce the effect of characteristic variation of a drive transistor and achieve a favorable gray scale expression even at a low luminance.

FIG. 5(*c*) is a circuit diagram illustrating Modification Example 11 of the first embodiment. The present modification example differs from Modification Example 10 in that two diode connection transistors $M_{D2}$ and $M_{D3}$ are connected in series, and the low level side voltage VSS is input to the back gates of the drive transistor $M_{D1}$ and diode connection transistor $M_{D2}$. Among a plurality of diode connection transistors, one closer to and one farther from the drive transistor are referred to as an upstream side and a downstream side, respectively. Using the above-described modeling and calculation, the subthreshold coefficient S obtained by combining the drive transistor $M_{D1}$ and diode connection transistors $M_{D2}$ and $M_{D3}$ according to the present modification example is as below:

$$S=(3+3k+k^2)S_0 \quad \text{(Equation 8)}$$

Accordingly, it can be found that the subthreshold coefficient S can be expressed by a quadratic function of k, and is further increased more than in Modification Example 10. In the present comparative example, a squared term of k appears in the subthreshold coefficient S, so the greater a value of the capacitance ratio k, the greater an amount of increase in the subthreshold coefficient S, which is more preferable.

Figure 6:
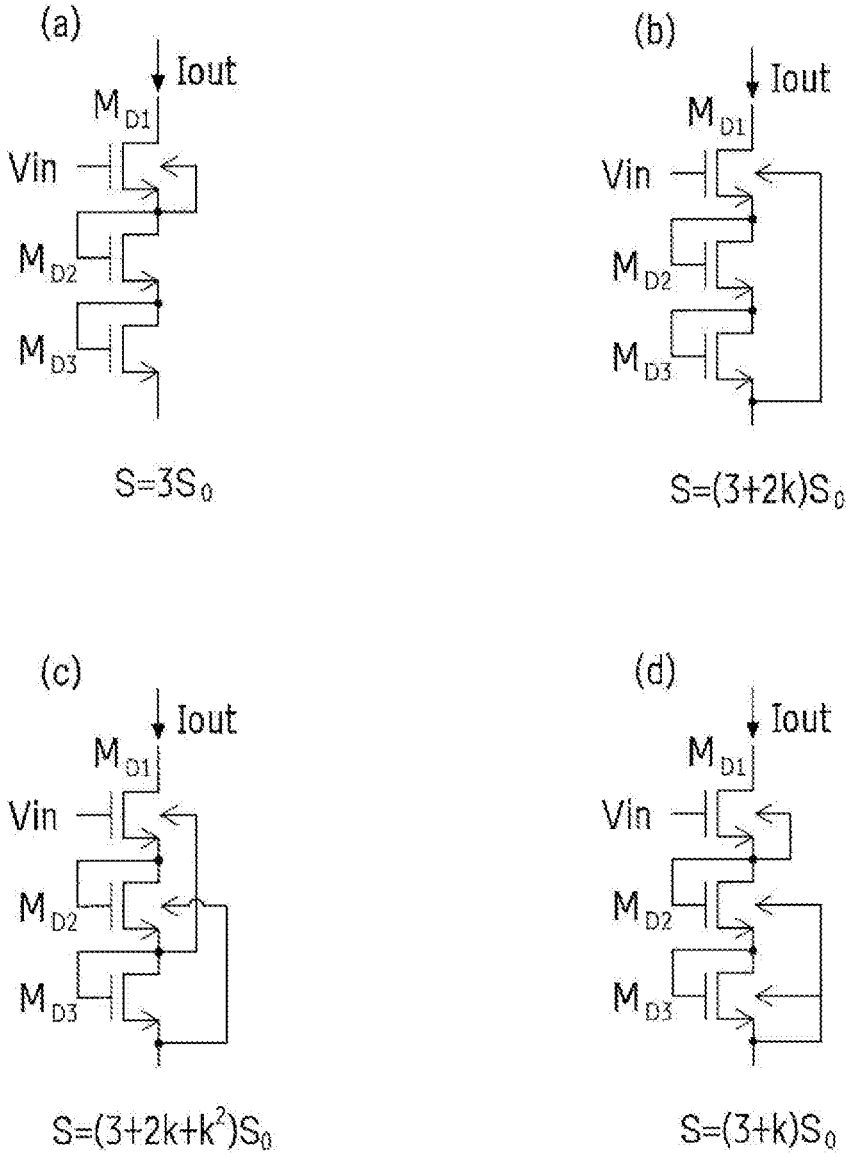
FIG. 6 is a circuit diagram illustrating organic EL display devices according to Modification Examples 12 to 15 of the first embodiment, where FIG. 6(*a*) illustrates Modification Example 12, FIG. 6(*b*) illustrates Modification Example 13, FIG. 6(*c*) illustrates Modification Example 14, and FIG. 6(*d*) illustrates Modification Example 15.

FIG. 6 is a circuit diagram illustrating organic EL display devices according to Modification Examples 12 to 15 of the first embodiment, where FIG. 6(*a*) illustrates Modification Example 12, FIG. 6(*b*) illustrates Modification Example 13, FIG. 6(*c*) illustrates Modification Example 14, and FIG. 6(*d*) illustrates Modification Example 15.

FIG. 6(*a*) is a circuit diagram illustrating Modification Example 12 of the first embodiment. The present modification example differs from Modification Example 11 in that two diode connection transistors $M_{D2}$ and $M_{D3}$ are connected in series, and a source potential of the drive transistor $M_{D1}$ is input to the back gate of the drive transistor $M_{D1}$. Using the above-described modeling and calculation, the subthreshold coefficient S obtained by combining the drive transistor $M_{D1}$ and diode connection transistors $M_{D2}$ and $M_{D3}$ according to the present modification example is as below:

$$S=3S_0 \quad \text{(Equation 9)}$$

Accordingly, the subthreshold coefficient S is three times that of a single transistor and is preferably increased more than Comparative Example 1.

FIG. 6(*b*) is a circuit diagram illustrating Modification Example 13 of the first embodiment. The present modification example differs from Modification Examples 11 and 12 in that two diode connection transistors $M_{D2}$ and $M_{D3}$ are connected in series, and a source potential of the diode connection transistor $M_{D3}$ is input to the back gate of the drive transistor $M_{D1}$. Using the above-described modeling and calculation, the subthreshold coefficient S obtained by combining the drive transistor $M_{D1}$ and diode connection transistors $M_{D2}$ and $M_{D3}$ according to the present modification example is as below:

$$S=(3+2k)S_0 \quad \text{(Equation 10)}$$

Accordingly, the subthreshold coefficient S can be expressed by a linear function of k, and is preferably increased by $2kS_0$ more than in Modification Example 12.

FIG. 6(*c*) is a circuit diagram illustrating Modification Example 14 of the first embodiment. The present modification example differs from Modification Examples 11 to 13 in that two diode connection transistors $M_{D2}$ and $M_{D3}$ are connected in series, a source potential of the diode connection transistor $M_{D3}$ is input to the back gate of the diode connection transistor $M_{D2}$, and a source potential of the diode connection transistor $M_{D2}$ is input to the back gate of the drive transistor $M_{D1}$. Using the above-described modeling and calculation, the subthreshold coefficient S obtained by combining the drive transistor $M_{D1}$ and diode connection transistors $M_{D2}$ and $M_{D3}$ according to the present modification example is as below:

$$S=(3+2k+k^2)S_0 \quad \text{(Equation 11)}$$

Accordingly, the subthreshold coefficient S can be expressed by a quadratic function of k, and is preferably further increased than in Modification Example 13.

FIG. 6(*d*) is a circuit diagram illustrating Modification Example 15 of the first embodiment. The present modification example differs from Modification Examples 11 to 14 in that two diode connection transistors $M_{D2}$ and $M_{D3}$ are connected in series, and a source potential of the diode connection transistor $M_{D3}$ is input to the back gates of the diode connection transistors $M_{D2}$ and $M_{D3}$, and a source potential of the drive transistor $M_{D1}$ is input to the back gate of the drive transistor $M_{D1}$. Using the above-described modeling and calculation, the subthreshold coefficient S obtained by combining the drive transistor $M_{D1}$ and diode connection transistors $M_{D2}$ and $M_{D3}$ according to the present modification example is as below:

$$S=(3+k)S_0 \quad \text{(Equation 12)}$$

Accordingly, the subthreshold coefficient S can be expressed by a linear function of k, and is preferably further increased than in Modification Example 12.

In FIG. 5 and FIG. 6, the examples in which two diode connection transistors $M_{D2}$ and $M_{D3}$ are connected directly are illustrated, but the number of diode connection transistors connected in multiple stages is not limited, and may be three or more.

Figure 7:
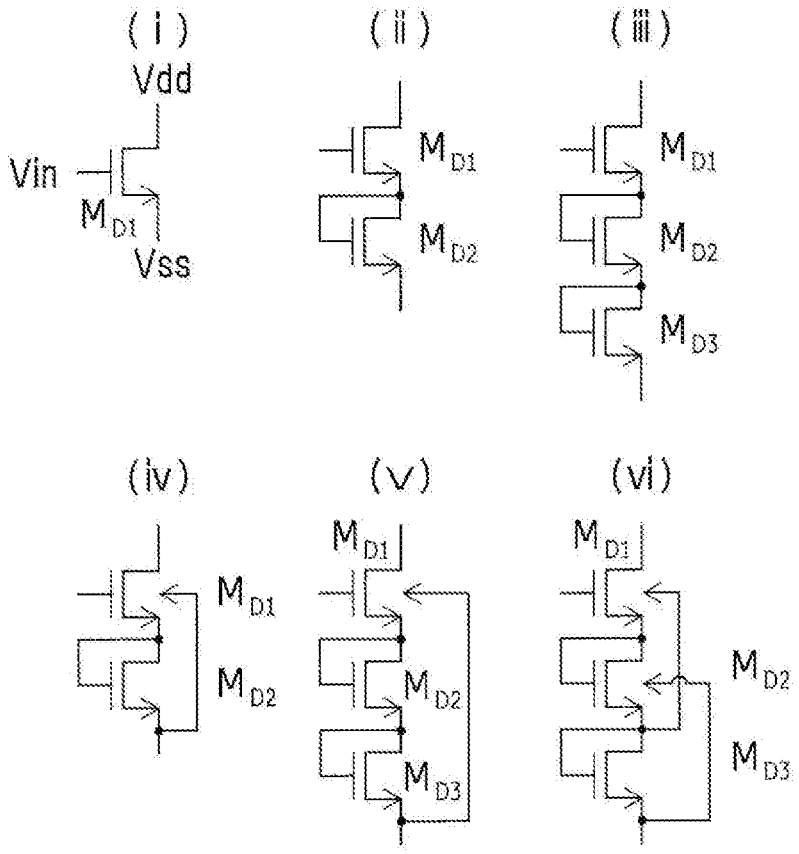
FIG. 7 is a circuit diagram illustrating various connection relationships between a drive transistor $M_{D1}$ and diode connection transistors $M_{D2}$ and $M_{D3}$.
Figure 8:
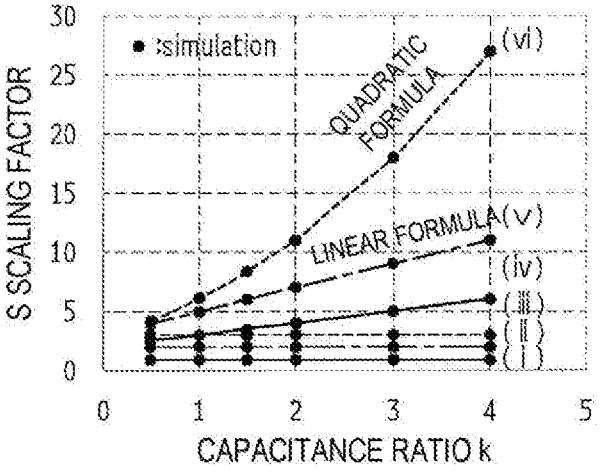
FIG. 8 is a graph illustrating a relationship between a capacitance ratio k and a value of a subthreshold coefficient S.
Figure 9:
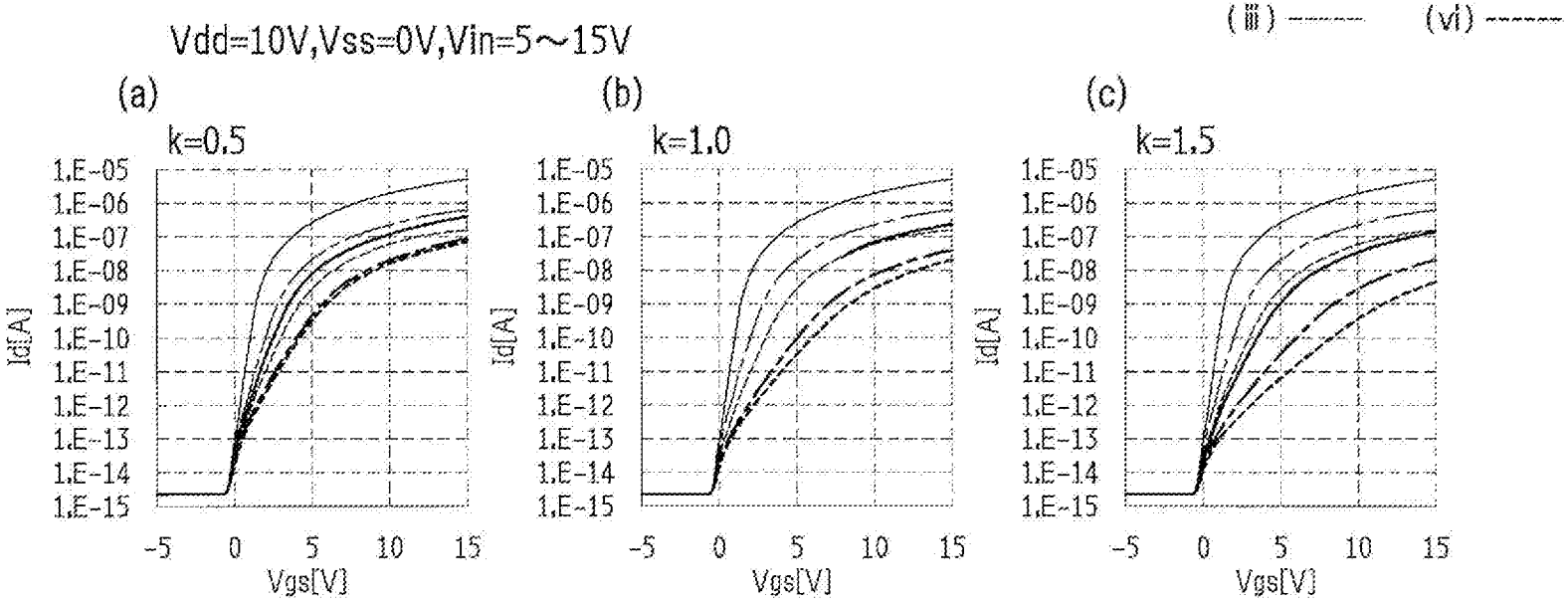
FIG. 9 is a graph illustrating relationships between a gate-source voltage Vgs and a current value Id of the drive transistor $M_{D1}$, where FIG. 9(*a*) illustrates a case of k=0.5, FIG. 9(*b*) illustrates a case of k=1.0, and FIG. 9(*c*) illustrates a case of k=1.5.

Next, a dependence of the subthreshold coefficient S on k when the back gate side capacitance of the transistor is $C_{BGI}$, the drive gate side capacitance is $C_{GI}$, and the capacitance ratio $k=C_{BGI}/C_{GI}$ is described using FIG. 7 to FIG. 9. FIG. 7 is a circuit diagram illustrating various connection relationships between the drive transistor $M_{D1}$ and the diode connection transistors $M_{D2}$ and $M_{D3}$. In FIG. 7, (i) illustrates Comparative Example 2 of the drive transistor $M_{D1}$ alone, (ii) illustrates Comparative Example 1, and (iii) illustrates Comparative Example 3 in which the drive transistor $M_{D1}$ and the diode connection transistors $M_{D2}$ and $M_{D3}$ are connected in series. Furthermore, in FIG. 7, (iv) illustrates Modification Example 10, (v) illustrates Modification Example 12, and (vi) illustrates Modification Example 13.

FIG. 8 is a graph illustrating a relationship between the capacitance ratio k and a value of the subthreshold coefficient S. A horizontal axis in FIG. 8 indicates the capacitance ratio $k=C_{BGI}/C_{GI}$, and a vertical axis indicates a S value scaling factor indicating what times the $S_0$ the subthreshold coefficient is. Lines illustrated in (i) to (vi) in the graphs indicate the relationship between the capacitance ratio k and the value of the subthreshold coefficient S in the circuits illustrated in (i) to (vi) of FIG. 7.

As illustrated in FIG. 8, in (i) to (iii), regardless of the value of the capacitance ratio k, the subthreshold coefficient S does not change at $S_0$, $2S_0$, and $3S_0$. On the other hand, in Modification Examples 10 of (iv) and 12 of (v), the subthreshold coefficient S is expresses by a linear formula of k, and thus, as the capacitance ratio k increases, the subthreshold coefficient S also increases. In particular, in Modification Example 10 of (iv), the subthreshold coefficient S is greater in a region of $k>1$ than in Comparative Example 3 of (iii). Therefore, the subthreshold coefficient S can be preferably increased even if the diode connection transistor $M_{D3}$ is not used and the number of transistors is less than in Comparative Example 3 of (iii). In addition, in Modification Example 13 of (vi), the subthreshold coefficient S is expressed by a quadratic formula of k, and thus, as the capacitance ratio k increases, the subthreshold coefficient S preferably also further increases.

FIG. 9 is a graph illustrating relationships between a gate-source voltage Vgs and a current value Id of the drive transistor $M_{D1}$, where FIG. 9(*a*) illustrates a case of k=0.5, FIG. 9(*b*) illustrates a case of k=1.0, and FIG. 9(*c*) illustrates a case of k=1.5. A horizontal axis in each of FIGS. 9(*a*) to (*c*) indicates the gate-source voltage Vgs, and a vertical axis indicates the current value Id. Lines illustrated in (i) to (vi) in the graphs represent the characteristics of the circuits illustrated in (i) to (vi) of FIG. 7.

It can be found, from FIGS. 9(*a*) to (*c*), that the greater the subthreshold coefficient S, the smaller a slope of the line, and the smaller a change in the current value Id with respect to a change in the gate-source voltage Vgs. Additionally, it can be found that the greater the value of the capacitance ratio k, the smaller the slope of the line, and the smaller the change in the current value Id with respect to the change in the gate-source voltage Vgs. In particular, in a case that the subthreshold coefficient S is expressed by a linear formula of the capacitance ratio k, the slope of the line is smaller, and in a case expressed by a quadratic formula, the slope of the line is further smaller.

As illustrated in FIG. 7 to FIG. 9, it can be found that the relationship between the gate voltage and the current value in the subthreshold characteristics of the drive transistor $M_{D1}$ is adjusted by the constant potential $V_{B1}$ input to the back gate of the drive transistor $M_{D1}$ so that the change in the current value due to the change in the gate voltage is gradual. By doing so, a subthreshold region of the drive transistor $M_{D1}$ is widened, and a difference between the data voltages $V_{in}$ required to change the current $I_{out}$ by one gray scale is increased, and gray scale control can be performed favorably within a control range of the voltage value output from the data driver. Accordingly, the effect of characteristic variation of a drive transistor can be reduced and a favorable gray scale expression can be achieved even at a low luminance.

Second Embodiment

Figure 10:
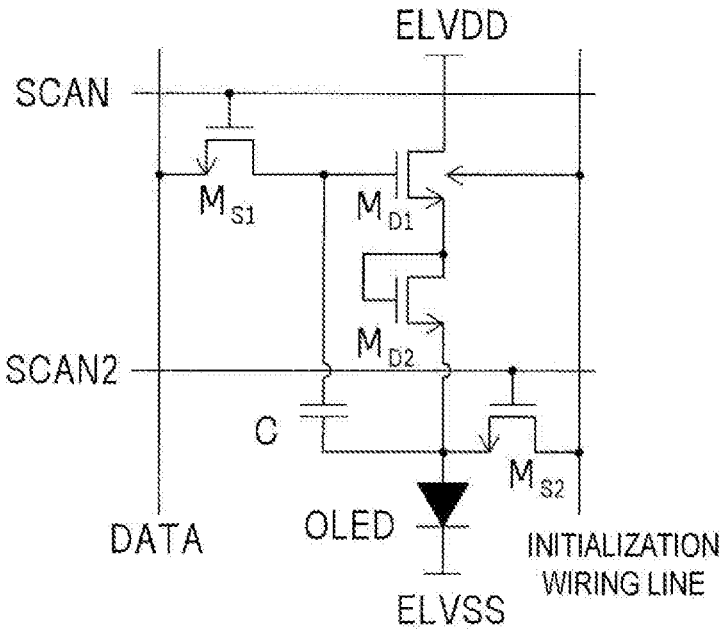
FIG. 10 is a circuit diagram illustrating one pixel of an organic EL display device according to a second embodiment.

Next, a second embodiment of the disclosure will be described with reference to the drawings. Configurations overlapping the first embodiment are omitted from the description. FIG. 10 is a circuit diagram illustrating one pixel of an organic EL display device according to the present embodiment.

As illustrated in FIG. 10, the organic EL display device of the present embodiment includes a drive transistor $M_{D1}$, a diode connection transistor $M_{D2}$, an organic EL element OLED, switching transistors $M_{S1}$ and $M_{S2}$, a capacitance C, a data line DATA, scanning lines SCAN1 and SCAN2, an initialization wiring line, a high level power source line ELVDD, and a low level power source line ELVSS. A connection relationship between the drive transistor $M_{D1}$, the diode connection transistor $M_{D2}$, and the organic EL element OLED is the same as Modification Example 1 of the first embodiment.

The switching transistors $M_{S1}$ has a gate connected to the scanning line SCAN1, a source connected to the data line DATA, and a drain connected to a gate of the drive transistor $M_{D1}$. The switching transistors $M_{S2}$ has a gate connected to the scanning line SCAN2, a source connected to an anode of the organic EL element OLED, and a drain connected to the initialization wiring line. The capacitances C has one side connected to the gate of the drive transistor $M_{D1}$ and the other side connected to the anode of the organic EL element OLED. The drive transistor $M_{D1}$ has a back gate connected to the initialization wiring line.

In the present embodiment also, since an initialization voltage of the initialization wiring line as the constant potential $V_{B1}$ input to the back gate of the drive transistor $M_{D1}$, the relationship between the gate voltage and the current value in the subthreshold characteristics of the drive transistor $M_{D1}$ is adjusted so that the change in the current value due to the change in the gate voltage is gradual. Accordingly, a subthreshold region of the drive transistor $M_{D1}$ is widened, and a difference between the data voltages $V_{in}$ required to change the current $I_{out}$ by one gray scale is increased, and gray scale control can be performed favorably within a control range of the voltage value output from the data driver. This can reduce the effect of characteristic variation of a drive transistor and achieve a favorable gray scale expression even at a low luminance.

Figure 11:
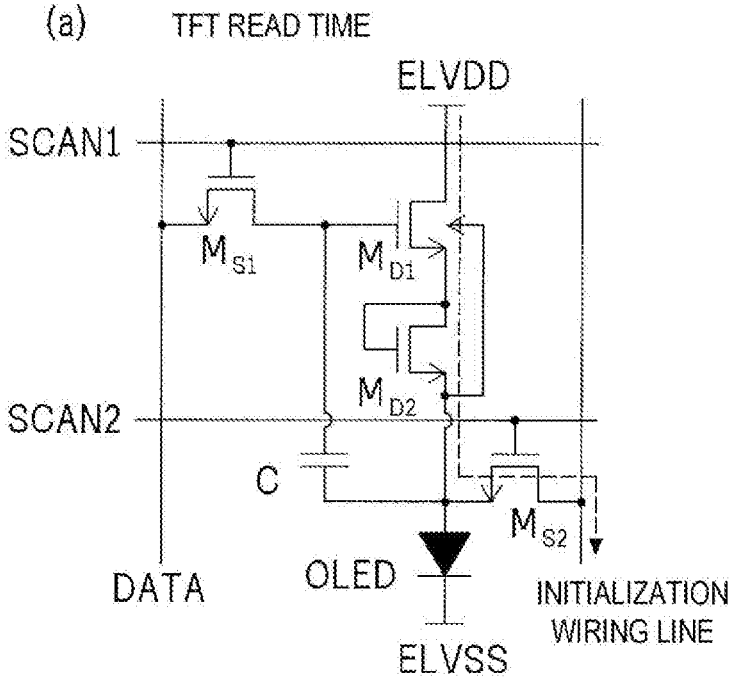
FIG. 11 is a diagram illustrating an external compensation operation according to the second embodiment, where FIG. 11(*a*) illustrates a TFT read time operation and FIG. 11(*b*) illustrates an EL element read time operation.
Figure 11:
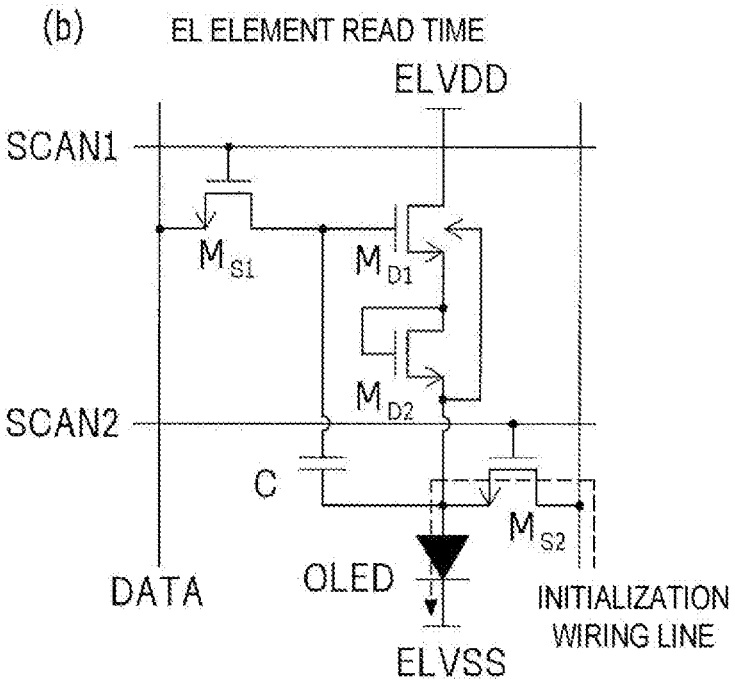

Next, an external compensation according to the present embodiment will be described with reference to FIG. 11. FIG. 11 is a diagram illustrating an external compensation operation according to the present embodiment, where FIG. 11(*a*) illustrates a TFT read time operation and FIG. 11(*b*) illustrates an EL element read time operation.

First, the scanning line SCAN1 is set to a high potential to turn on the switching transistor $M_{S1}$, and a data voltage for transistor read is applied from the data line DATA to the gate of the drive transistor $M_{D1}$ and the capacitance C. As a result, the drive transistor $M_{D1}$ becomes conductive.

After that, the scanning line SCAN2 is set to a high potential to turn on the switching transistor MS2, and as illustrated in FIG. 11(*a*), the current value flowing from the high level power source line ELVDD through the drive transistor $M_{D1}$, the diode connection transistor $M_{D2}$, and the switching transistor $M_{S2}$ to the initialization wiring line is measured. This TFT read operation can read the transistor characteristics obtained by combining the drive transistor $M_{D1}$ and the diode connection transistor $M_{D2}$.

Next, the scanning line SCAN1 is set to a high potential to turn on the switching transistor $M_{S1}$, and a data voltage for EL element read is applied from the data line DATA to the gate of the drive transistor $M_{D1}$ and the capacitance C. As a result, the drive transistor $M_{D1}$ is turned off to stop the current from the high level power source line ELVDD.

After that, the scanning line SCAN2 is set to a high potential to turn on the switching transistor $M_{S2}$, and as illustrated in FIG. 11(*b*), the current value flowing from the initialization wiring line through the switching transistor $M_{S2}$ and the organic EL element OLED to the low level power source line ELVSS is measured. This EL element read operation can read the characteristics of the organic EL element OLED.

As described above, the organic EL display device according to the present embodiment performs the TFT read operation and the EL element read operation to perform the external compensation. By doing so, the transistor characteristics obtained by combining the drive transistor $M_{D1}$ and the diode connection transistor $M_{D2}$, and the characteristics of the organic EL element OLED can be read, and the data voltage supplied from the data line DATA can be adjusted to improve display characteristics.

Third Embodiment

Figure 12:
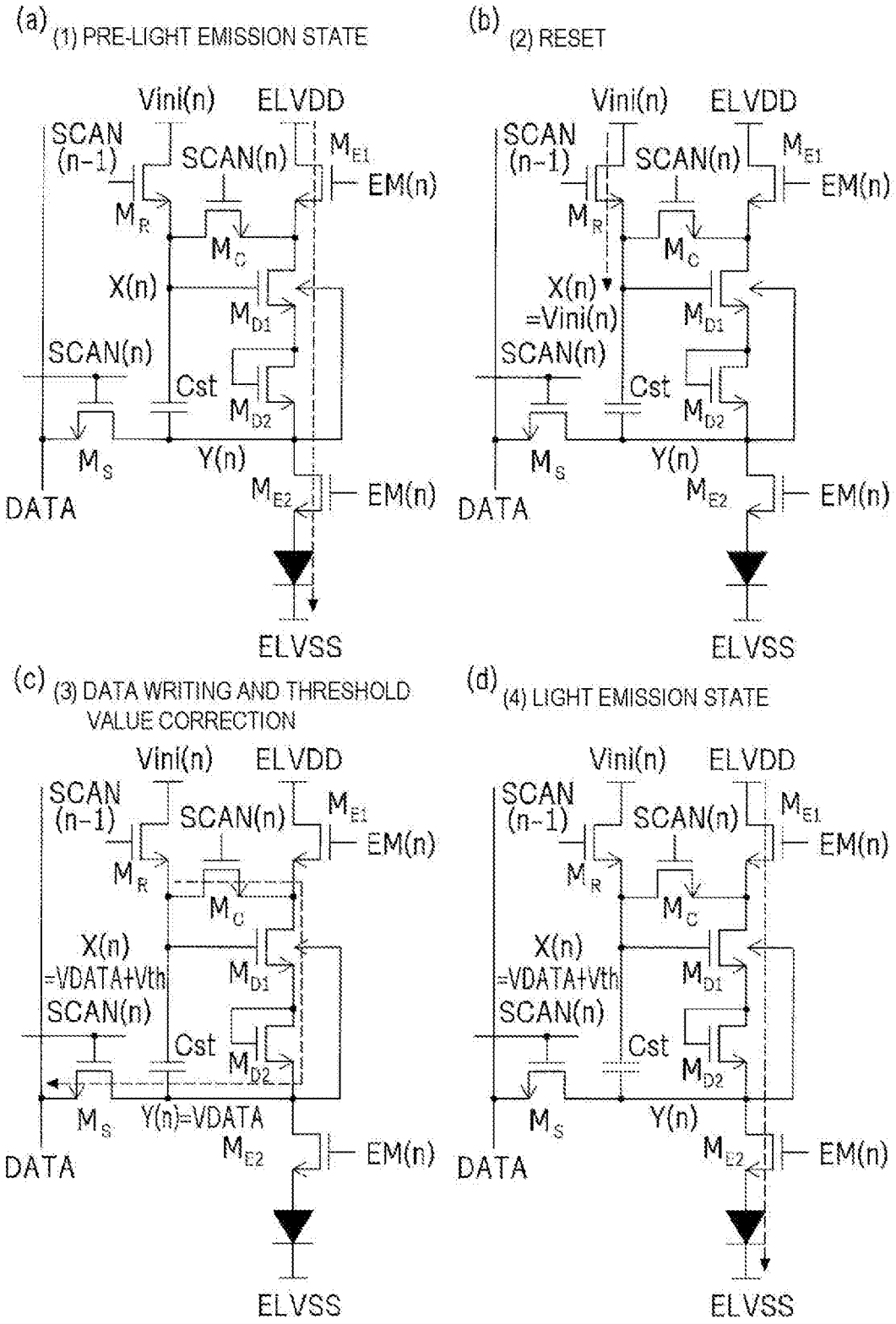
FIG. 12 is a diagram illustrating an internal compensation operation of an organic EL display device according to a third embodiment, where FIG. 12(*a*) illustrates a pre-light emission state, FIG. 12(*b*) illustrates a reset state, FIG. 12(*c*) illustrates data writing and threshold value correction, and FIG. 12(*d*) illustrates a light emission state.
Figure 13:
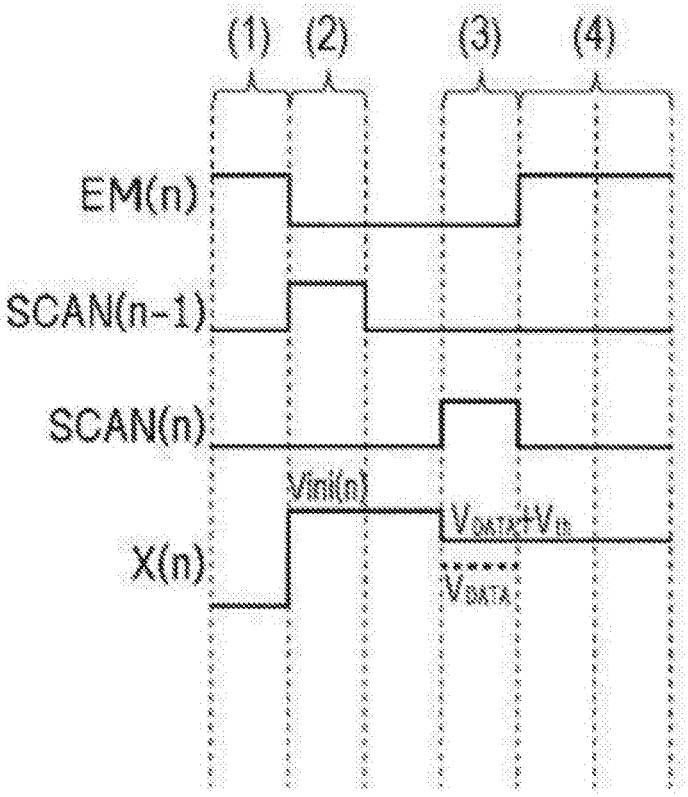
FIG. 13 is a timing chart of the organic EL display device according to the third embodiment.

Next, a third embodiment of the disclosure will be described with reference to the drawings. Configurations overlapping the first embodiment are omitted from the description. FIG. 12 is a diagram illustrating an internal compensation operation of an organic EL display device according to the present embodiment, where FIG. 12(*a*)

illustrates a pre-light emission state, FIG. 12(*b*) illustrates a reset state, FIG. 12(*c*) illustrates data writing and threshold value correction, and FIG. 12(*d*) illustrates a light emission state. FIG. 13 is a timing chart of the organic EL display device according to the present embodiment.

As illustrated in FIGS. 12(*a*) to (*d*), the organic EL display device according to the present embodiment includes a drive transistor $M_{D1}$, a diode connection transistor $M_{D2}$, an organic EL element OLED, a switching transistor $M_S$, a reset transistor $M_R$, transistors $M_C$, $M_{E1}$, and $M_{E2}$, a capacitance Cst, a data line DATA, scanning lines SCAN(n) and SCAN (n−1), a light emission control line EM(n), a high level power source line ELVDD, and a low level power source line ELVSS. Respective connection relationships are as illustrated in the figures.

The transistor $M_{E1}$ has a drain connected to the high level power source line ELVDD, a source connected to a drain of the drive transistor $M_{D1}$, and a gate connected to the light emission control line EM(n). The transistor $M_{E1}$ corresponds to a first transistor in the disclosure.

The transistor $M_{E2}$ has a drain connected to a node Y(n), a source connected to an anode of the organic EL element OLED, and a gate connected to the light emission control line EM(n). The transistor $M_{E2}$ corresponds to a second transistor in the disclosure.

The transistor $M_C$ has a drain connected to a node X(n), a source connected to the drain of the drive transistor $M_{D1}$, and a gate connected to the scanning line SCAN(n). The transistor $M_C$ corresponds to a third transistor in the disclosure.

The reset transistor $M_R$ has a drain connected to the initialization line, a source connected to the node X(n), and a gate connected to the scanning line SCAN(n−1). The switching transistor $M_S$ has a source connected to the data line DATA, a drain connected to the node Y(n), and a gate connected to the scanning line SCAN(n). The capacitance Cst has one side connected to the node X(n) and the other side connected to the node Y(n). Also, the node Y(n) is connected to the back gate of drive transistor $M_{D1}$.

The node X(n) is connected to the gate of the drive transistor $M_{D1}$, the drain of the transistor $M_C$, the source of the reset transistor $M_R$, and one side of the capacitance Cst, and corresponds to a first node in the disclosure. The node Y(n) is connected to the source of the diode connection transistor $M_{D2}$, the drain of the transistor $M_{E2}$, the other side of the capacitance Cst, the drain of the switching transistor $M_S$, and the back gate of the drive transistor $M_{D1}$, and corresponds to a second node in the disclosure. In addition, the capacitance Cst corresponds to a second capacitance in the disclosure, the scanning line SCAN(n−1) corresponds to a first scanning line in the disclosure, and the scanning line SCAN (n) corresponds to a second scanning line in the disclosure.

First, in the pre-light emission state illustrated in FIG. 12(*a*), an on signal is supplied to EM(n) and an off signal is supplied to SCAN(n−1) and SCAN(n) as illustrated in (1) of FIG. 13. Thus, the switching transistor $M_S$, the reset transistor $M_R$, and the transistor $M_C$ are in the off state, and the node X(n) is at a pre-light emission potential. At this time, a current flows from the high level power source line ELVDD through the transistor $M_{E1}$, the drive transistor $M_{D1}$, the diode connection transistor $M_{D2}$, the transistor $M_{E2}$, and the organic EL element OLED to the low level power source line ELVSS, and the organic EL element OLED pre-emits the light.

Next, in the reset state illustrated in FIG. 12(*b*), an off signal is supplied to EM(n), an on signal is supplied to SCAN(n−1), and an off signal is supplied to SCAN(n) as illustrated in (2) of FIG. 13. Thus, the switching transistor $M_S$ and the transistors $M_C$, $M_{E1}$, and $M_{E2}$ are in the off state, and node X(n) is initialized to a potential Vini(n).

Next, in the data writing and threshold value correction illustrated in FIG. 12(*c*), an off signal is supplied to EM(n), an off signal is supplied to SCAN(n−1), and an on signal is supplied to SCAN(n) as illustrated in (3) of FIG. 13. Thus, the reset transistor $M_R$ and the transistors $M_{E1}$ and $M_{E2}$ are in the off state, and the drive transistor $M_{D1}$, the switching transistor $M_S$, and the transistor $M_C$ are in the on state. At this time, a charge charged to the capacitance Cst in the reset state flows through the transistor $M_C$, the drive transistor $M_{D1}$, the diode connection transistor $M_{D2}$, and the switching transistor $M_S$ to the data line DATA, and the node X(n) is at a sum of a data voltage Vdata and the threshold voltage Vth. Here, the threshold voltage Vth is a threshold voltage in a case that the drive transistor $M_{D1}$ and the diode connection transistor $M_{D2}$ are combined and regarded as one transistor.

Next, in the light emission state illustrated in FIG. 12(*d*), an on signal is supplied to EM(n) and an off signal is supplied to SCAN(n−1) and SCAN(n) as illustrated in (4) of FIG. 13. Thus, the reset transistor $M_R$, the transistor $M_C$, and the switching transistor $M_S$ are in the off state, and the transistors $M_{E1}$ and $M_{E2}$, and the drive transistor $M_{D1}$ are in the on state. At this time, the node X(n) is held at the sum of the data voltage Vdata and the threshold voltage Vth by the capacitance Cst. This allows a current to flow from the high level power source line ELVDD through the transistor $M_{E1}$, the drive transistor $M_{D1}$, the diode connection transistor $M_{D2}$, the transistor $M_{E2}$, and the organic EL element OLED to the low level power source line ELVSS, and the organic EL element OLED emits the light.

As described above, in the organic EL display device according to the present embodiment, the pre-emission and reset, and the data writing and threshold value correction are performed to perform the internal compensation. By doing so, the transistor characteristics obtained by combining the drive transistor $M_{D1}$ and the diode connection transistor $M_{D2}$ can be compensated to improve the display characteristics.

In addition, the display element used for the disclosure is not limited to only the organic EL display device using the organic EL element as long as the display device is a display device provided with various display elements with luminance and transmittance controlled by a current. Examples of the current-controlled display element include organic Electro Luminescent (EL) displays equipped with Organic Light Emitting Diodes (OLED), EL displays such as inorganic EL displays equipped with inorganic light-emitting diodes, and Quantum dot Light Emitting Diode (QLED) displays equipped with QLED.

Note that the presently disclosed embodiments are illustrative in all respects and are not basis for limiting interpretation. Accordingly, the technical scope of the disclosure is not to be construed by the foregoing embodiments only, but is defined based on the description of the claims. The technical scope of the disclosure also includes all changes in the meaning and scope equivalent to the claims.

The invention claimed is:

1. A display device comprising:

a display element emitting light by current flowing;

a drive transistor controlling the current flowing through the display element;

a diode connection transistor connected to a source side of the drive transistor;

a first transistor including a drain connected to a high-level power source wiring line and a gate connected to a light emission control line;

a second transistor including a source connected to an anode of the display element and a gate connected to the light emission control line;

a reset transistor including a drain connected to an initialization line and a gate connected to a first scanning line;

a switching transistor including a source connected to a data line and a gate connected to a second scanning line;

a third transistor including a source connected to a source of the first transistor and a gate connected to the second scanning line; and a capacitance, wherein a constant potential is input to a back gate of the drive transistor, the drive transistor and the diode connection transistor are connected between the source of the first transistor and a drain of the second transistor, a gate of the drive transistor, a drain of the third transistor, a source of the reset transistor, and one side of the capacitance are connected to a first node, and a source of the diode connection transistor, the drain of the second transistor, a second side of the capacitance, a drain of the switching transistor, and the back gate are connected to a second node.

2. A display device comprising:

a display element emitting light by current flowing;

a drive transistor controlling the current flowing through the display element; and a diode connection transistor connected to a source side of the drive transistor, wherein a constant potential is input to a back gate of the drive transistor, and when a back gate side capacitance of the drive transistor is $C_{BGI}$, a drive gate side capacitance of the drive transistor is $C_{GI}$, and a capacitance ratio $k=C_{BGI}/C_{GI}$, a subthreshold coefficient S obtained by combining the drive transistor and the diode connection transistor is expressed by a linear function of k.

3. The display device according to claim 2, wherein when a subthreshold coefficient of only the drive transistor or the diode connection transistor is $S_0$, the subthreshold coefficient S obtained by combining the drive transistor and the diode connection transistor is defined by $S=(2+k)S_0$.

4. The display device according to claim 1, wherein the constant potential is constant for a period while the drive transistor is in an on state.

* * * * *